United States Patent [19]

Bosaeus

[11] 4,162,703

[45] Jul. 31, 1979

[54] PLATE-TYPE HEAT EXCHANGER

[75] Inventor: Jan A. Bosaeus, Nyköping, Sweden

[73] Assignee: Aktiebolaget Atomenergi, Stockholm, Sweden

[21] Appl. No.: 769,234

[22] Filed: Feb. 11, 1977

[30] Foreign Application Priority Data

Feb. 12, 1976 [SE] Sweden ..... 7601607

[51] Int. Cl.[2] ..... F28F 3/08

[52] U.S. Cl. ..... 165/167

[58] Field of Search ..... 165/166, 167

[56] References Cited

U.S. PATENT DOCUMENTS

| | | | |
|---|---|---|---|
| 2,617,634 | 11/1952 | Jendrassik | 165/167 |
| 2,677,531 | 5/1954 | Hock | 165/167 |
| 3,244,227 | 4/1966 | Usher | 165/167 |
| 3,308,879 | 3/1967 | Maddocks | 165/167 |
| 3,372,744 | 3/1968 | Skoog | 165/167 |
| 3,438,435 | 4/1969 | Wennerberg | 165/167 |
| 3,743,011 | 8/1973 | Frost | 165/167 X |
| 3,759,308 | 9/1973 | Gebauer | 165/167 |
| 4,002,201 | 1/1977 | Donaldson | 165/167 X |

*Primary Examiner*—Ira s. Lazarus

*Attorney, Agent, or Firm*—Burns, Doane, Swecker & Mathis

[57] ABSTRACT

A plate-type heat exchanger comprises a stack of plates each of which comprises in a first direction a first end portion, a heat exchanger surface and a second end portion. In each end portion there are at least two parallel rows of openings namely one row of openings for one flow and another row of openings for another fluid. These rows are substantially parallel to each other and extend substantially perpendicular to said first direction. Thus, in each space between adjacent plates, one flow will pass between the screens which connect the spaces adjacent said space, wherein a pure counterflow heat exchange is provided for the heat exchanger.

11 Claims, 13 Drawing Figures

PLATE-TYPE HEAT EXCHANGER

The present invention relates to a heat exchanger comprising a stack of plates each of which comprises, in a first direction, a first end portion, a second end portion and an intervening heat exchanger surface, both the end portions exhibiting an inlet for the one flow and an outlet for the other, and means being provided in order to separate from one another the spaces located adjacent one another and between adjacent plates, every other one of said spaces carrying the one flow and the others carrying the other flow.

A plate heat exchanger of this general kind is well known from Swedish Pat. No. 182,214.

In this known heat exchanger, in both end portions the inlet and the outlet are located in the direction transversely of the longitudinal direction of the plates so that the heat exchanging effect achieved is a mixture of cross-flow and counterflow heat exchange, the flows in the heat exchange zone becoming asymmetrical and varying radically over the width of the heat exchanger surface. Amongst other things, this means that the available heat exchanger surface is poorly exploited.

One object of the present invention, therefore, is to provide a plate-type heat exchanger in which the heat exchange surface can be utilized in an optimum way.

Another object is to provide a plate-type heat exchanger in which pure counterflow heat exchange can be achieved.

The said drawbacks are avoided and the said objects achieved in accordance with the present invention, using a heat exchanger of the type discussed introductorily, which is so designed that the inlet and the outlet are each arranged in the form of a plurality of openings in each plate, which openings are located in one or more rows extending in a second direction transversely of the first direction of the plates, elements being provided in order to separate the inlet from the outlet in each end portion of the stack, in the spaces between adjacent plates, so that in each space all the openings of the inlet at one end portion of one plate, and all the openings of the outlet at the other end portion of the other plate, communicate with the space. The invention as well as embodiments thereof will be defined in the attached claims. The heat exchanger in accordance with the invention is intended especially as an air heat exchanger and will preferably consist of plastic although it could be made of aluminium or for that matter some other suitable material.

In the following, the invention will be described in more detail through the agency of examples making reference to the attached drawings.

Figure 1:
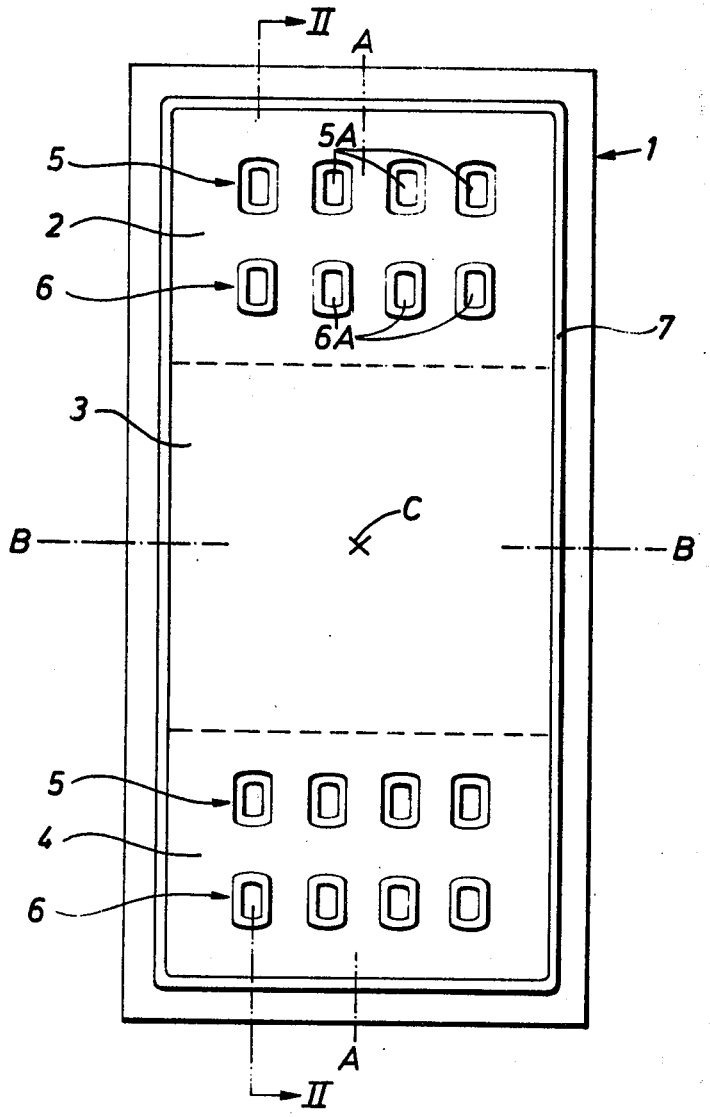
FIG. 1 illustrates a plan view of a plate belonging to the heat exchanger in accordance with the invention.
Figure 2:
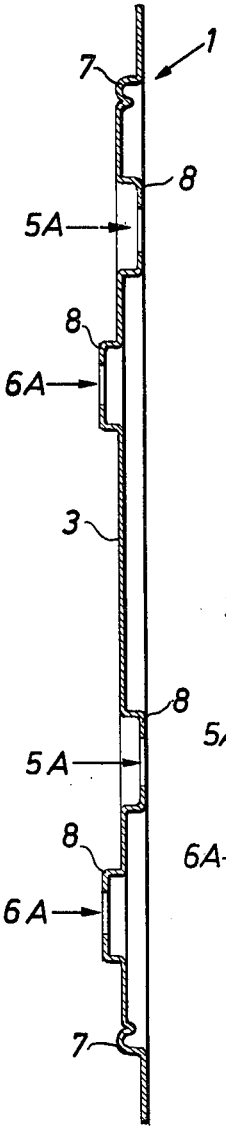
FIG. 2 is a section through the plate of FIG. 1, on the line 2.
Figure 3A:
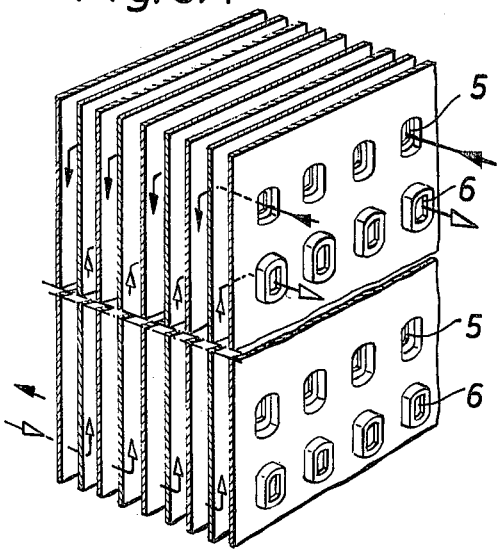
Figure 3:
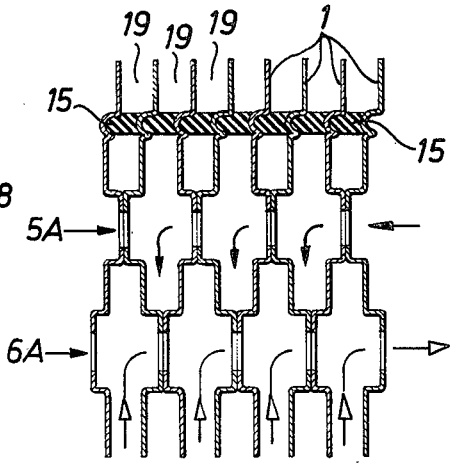

FIGS. 3 and 3A schematically illustrate a section through an end portion of a heat exchanger made up of plates of the kind shown in FIGS. 1 and 2.

Figure 4:
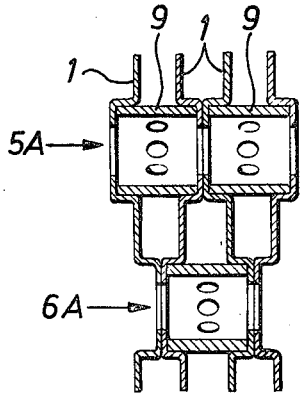

FIG. 4 illustrates how the heat exchanger can be designed at an end zone.

Figure 5:
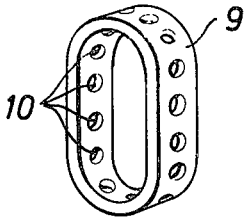

FIG. 5 illustrates a spacer used in the embodiment shown in FIG. 4.

Figure 6:
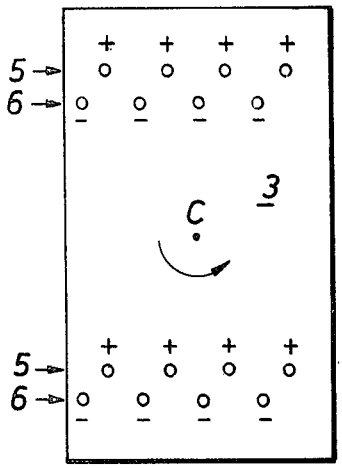
Figure 7:
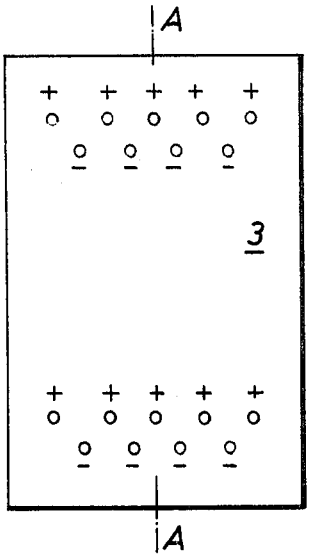
Figure 8:
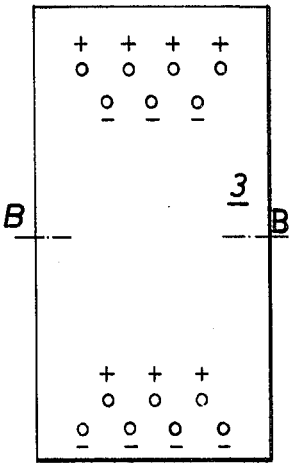

FIGS. 6, 7 and 8 illustrate different general embodiments of heat exchanger plates for the heat exchanger in accordance with the invention.

Figure 9:
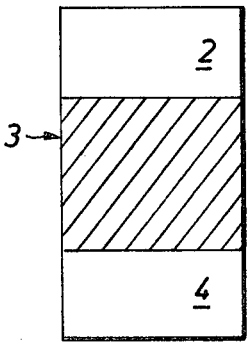
Figure 10:
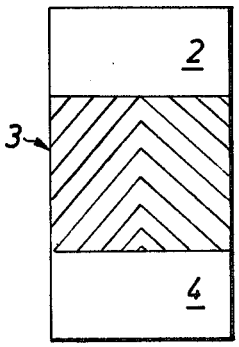

FIGS. 9 and 10 illustrate two possible embodiments of heat exchange surfaces associated with plates belonging to the heat exchanger in accordance with the invention.

Figure 11:
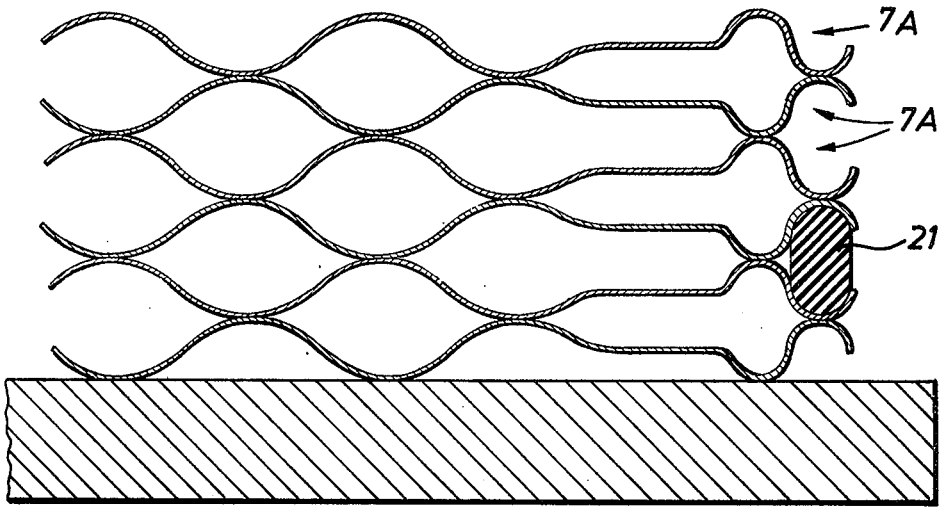

FIG. 11 illustrates how sealing can be effected at the peripheral zones of the plates.

Figure 12:
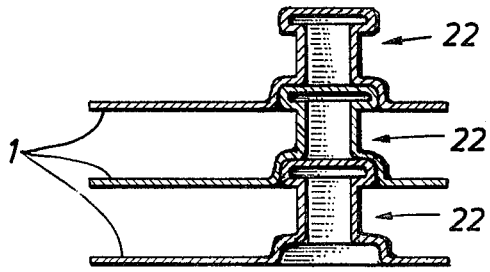

FIG. 12 illustrates another possible embodiment of the sealing arrangement between the peripheral zones of adjacent plates.

FIG. 1 illustrates a heat exchange plate 1 belonging to the heat exchanger in accordance with the invention. The plate 1, in a first direction A—A, exhibits a first end portion 2, a heat exchange surface 3 and a second end portion 4. The end portions 2 and 4 each exhibit a row of inlet openings 5 and a row of outlet openings 6. The plate 1, at its periphery, exhibits a groove 7 for a sealing ring. The plate 1, at each opening 5*a* and 6*a*, respectively, exhibits a collar 8 and the collars 8 of the openings 5*a* and 6*a* are oppositely directed in the manner shown in FIG. 2. The rows 5 and 6 of openings extend parallel to the direction B—B which is at right angles to that A—A . The geometric axes A—A and B—B intersect one another at the centre of the plate 1. A geometric axis C extends at right angles to the plate 1 through the point of intersection between the axes A—A and B—B.

The end portions 2 and 4 including the openings 5*a* and 6*a*, are symmetrically disposed in relation to a rotation of 180° about the axis so that the heat exchanger in accordance with the invention can be formed by stacking identical plates 1, each other plate being rotated 180° in its own plane relatively to adjacent plates 1.

This creates a stack of plates or heat exchanger of the general design shown in FIG. 3*a* which depicts the schematic flow chart of a heat exchanger of this kind.

FIG. 3 illustrates in more detail how the collars 8 in adjacent plates 1 co-operate in order to bring about separation from one another of the inlet and outlet flows.

As FIG. 3 shows, the collars 8 are so designed that collars on adjacent plates abut in sealing relationship against one another in each other space 19.

The plates 1 preferably consist of thin plate material so that it may be a good idea to provide spacer rings 9 between those collars 8 on adjacent plates, which face away from one another. The rings 9 are perforated in order to let out the one fluid into the gap the ring is located in, and in order to allow the other fluid to flow from the associated gap into the manifold passages 5 or 6. The ring 9 has a height approximately the same as twice the mutual interval between the plates 1. Due to the presence of the rings 9 the stack formed by the plates 1 can be compressed so that the collars 8 referred to are pressed tightly together avoiding any risk of individual plates distorting under stress.

In order for the heat exchanger surface 3 to be capable of retaining its shape and in order to promote the sort of turbulence which facilitates heat exchange, the heat exchange surface 3 should be corregated or be provided with support elements, for example lips or the like, which bear against the heat exchange surface of the adjacent plates 1, the contact locations preferably being punctiform. In the case of the embodiment shown in FIGS. 1 and 2, it may be a good idea to provide the plate 1 with corrugations in the heat exchange surface 3, the corrugations preferably running at an angle, preferably 45°, to the direction A—A, in the manner shown in FIGS. 9 and 10. In FIG. 10, it has been chosen to divide the heat exchange surface 1 into two panels 3a which are mirror-symmetrical in relation to the axis A—A.

The embodiment thus far described, is particularly suitable since it leads to the creation of a heat exchanger employing only one kind of plate 1. However, if we dispense with the provision of the groove 7 in the embodiment of FIGS. 1 and 2, and instead arrange the sealing element, for example a rubber ring, at the periphery of the plate 1, using a winding operation or the like, then it becomes possible, with a unitary type of plate, to create a heat exchanger in accordance with the invention by arranging for the plate 1 to be symmetrical in relation to the axis A—A or the axis B—B (compare FIGS. 6 to 8) so that the stack is produced by virtue of the fact that every other plate is rotated through 180° around the relevant geometric axis, when building up the stack of plates to form the heat exchanger in accordance with the invention.

It should, however, be clearly understood that the artifice of forming a plate 1 so that only one kind of plate 1 is required to produce a heat exchanger in accordance with the invention, only forms one part of the invention.

The essential feature of the invention is that the end portions of the plates 1 are arranged in such a fashion that at least the flow openings nearest the heat exchange surface 3 have the form of a row of uniformly spaced openings 5a and 6a, so that the other flow can pass into the space between the openings 5a and 6a of the rows.

This implies that it is entirely conceivable to use two types of plates 1 which are mutually mirror-symmetrical. If two types of plates are used, then no symmetry between individual plates is needed, but it is nevertheless highly important that the openings 5a in the rows 5 and those 6a in the rows 6, are fairly evenly distributed across the heat exchanger plates so that a uniform flow pattern is achieved between the heat exchange surfaces 3.

Thus, in order to put the inventive concept into effect, it is not necessary for the openings located closest to the edges of the plates to consist of rows of openings and instead these can just as well be replaced by a single opening extending substantially over the full width of the plate.

Referring now to FIGS. 2 and 3, a special peripheral pressed groove 7 in the plate 1 can be seen; the groove 7 being designed to receive a sealing ring 15. The groove 7 serves to facilitate correct positioning of the sealing ring 15 and its concave side exhibits a crease which can be arranged to control the opposite side of the sealing ring 15. It is worthy of note that there is a substantial advantage to be obtained if a sealing element 15 is fixed to each plate 1 since in this fashion handling during assembly of the heat exchanger in accordance with the invention is considerably eased.

It should also be noted that the heat exchange in accordance with the invention is primarily intended to operate as an air-air heat exchanger in order to transfer heat energy in the waste air from a building, to the input air into the building, and in this kind of application it can very readily happen that foreign bodies and rubbish can collect in a heat exchanger after a certain period of operation, so that it is a good idea if the stack of plates can readily be taken apart and cleaned and then just as easily reassembled. The heat exchanger in accordance with the invention fulfils this criterion.

The heat exchanger in accordance with the invention, however, is not limited to the field of application just referred to but in fact finds universal application as a heat exchanger and provides an extremely high level of efficiency compared with known heat exchangers, because of the complete counterflow heat exchange action it develops together with extremely uniform flows; thus, the heat exchanger in accordance with the invention very effectively utilises the theoretically highest possible heat exchange capacity.

Referring to FIGS. 6 to 8, we will now illustrate some different types of symmetrical design which are necessary if it is intended to manufacture the heat exchanger in accordance with the invention from a single kind of plate. The plus sign here for example signifies openings with collars which point to one side and the minus sign openings with collars which point to the other side, alternatively plus and minus signs can respectively signify inlet openings and outlet openings in the relevant end portions.

It should be clearly understood, however, that the collars 8 are not essential to the construction of the heat exchanger in accordance with the invention since it is entirely possible, instead of two collars 8 which point towards one another and effect a seal in relation to one another, these collars being located in adjacent plates 1, to provide between plates at the relevant openings, a ring of the kind shown in FIG. 5 although the ring 9 should not contain any holes 10.

The tube covers which are required at the flow inlet and flow outlet locations from the stack of plates in accordance with the invention, do not form part of the present invention but can have any suitable functionally appropriate form and the same applies to any external end plates between which the plate stack may be clamped.

The openings 5a and 6a will preferably have an oval or elongated shape, the major axis of an opening being disposed substantially parallel to the direction A—A. In this way, the openings 5a and 6a can be given a relatively large cross-sectional area without restricting the flow space between adjacent openings in the same row. Furthermore, it is of course an essential feature that the openings 5a and 6a have a large flow area since the passages defined by openings 5a and 6a which are directed towards one another, have to inject fluid into a plurality of gaps between the plates 1.

In a practical embodiment, by way of example it can be quoted that each flow passage formed by openings 5a or 6a which are directed towards one another, has an area of around 70 $cm^2$. Each outlet from the passage 5a, 6a to a gap 19 is designed to fill 10 cm of the gap width. If the plate stack contains 21 plates 1 and each gap 19 has an average height of 1 cm, thus each passage 5a or 6a must service a gap area of 100 $cm^2$ (the outflow from a passage 5a to the gaps 19 takes place only every other gap).

It should be understood, however, that the area of the openings 5a or 6a can be increased by extending them further in the direction A—A and in addition the passages 5a, 6a can be supplied and discharged respectively from both ends of the plate stack.

Obviously, too, the plates 1 can be designed in such a fashion that the gaps 19 are very narrow which has a favourable effect upon the external dimensions of the heat exchanger though it naturally implies an increased pressure across the heat exchanger. For each particular application, there is of course an optimum economic balance between these two factors.

FIG. 11 illustrates how sealing can be arranged between the peripheral zones of the plates 1, especially the plates designed in the manner shown in FIG. 8.

FIG. 11 illustrates a section through a peripheral zone of a longitudinal side of a stack of plates 1.

Each peripheral zone 7a of a plate, has a wave or "sinusoidal" (one period) shape. The height of wave crest and wave trough from the base plane of the plate 1, is around half the interval between the base planes of neighbouring plates 1.

Since every other plate 1 is rotated through 180° in relation to the axis B, adjacent plates alternately abut against one another in sealing fashion first with the wave crest portion and then with the wave trough portions. These contact locations extend continuously around the whole periphery of the plates. If required, self-evidently packing rings 21 can be arranged in the spaces between the edge zones 7a of adjacent plates, these rings preferably having a height corresponding to twice the mutual interval between the base planes of adjacent plates 1, and the rings preferably having such a shape that they completely fill out the space between the respective wave formations of adjacent plates 1.

Especially in the case where the plates 1 are designed in the manner shown in FIG. 6, the peripheral zones of the plates 1 can be given a relatively sharp crease 22 so that creases 22 in adjacent plates 1 can be snapped into one another or at least supported against one another. An example of this design is shown in FIG. 12.

The ring 9 of FIG. 5 can of course be modified in a variety of ways, preferably to adapt it for mass production so that it can for example be injection-moulded. In this context, it may be a good idea to design a ring 9 as a circumferential strip exhibiting a plurality of teeth projecting in opposite directions in relation to the plane of the ring 9. Equally, it may be possible in principle to manufacture the ring in accordance with FIG. 5, in the form of two substantially identical halves intended for permanent fixing in their respective associated plates 1, this further facilitating the assembly and dismantling of the plate-type heat exchanger.

What is claimed is:

1. A heat exchanger comprising:

a plurality of plates arranged in a stack, each plate having, in a first direction, a first end portion, a second end portion and an intervening heat exchange surface, the first end portion having both an inlet passageway for a first fluid and an outlet passageway for a second fluid, and the second end portion having both an inlet passageway for the second fluid and an outlet passageway for the first fluid, means being provided in order to for separating the plates from one another to define spaces, the spaces being located adjacent one another with each space being between adjacent plates, the space on one side of each plate carrying the first fluid and the space on the other side of each plate carrying the second fluid, the inlet and the outlet of each end portion each being arranged in the form of a plurality of openings located in at least one row extending in a second direction transversely of the first direction of the plates, and elements for separating the inlet from the outlet in each end portion of each plate, the elements being provided in the spaces between the adjacent plates, with all the openings of the inlet at one end portion of each plate, and all the openings of the outlet at the other end portion of the adjacent plate, communicating with the space between the adjacent plates.

2. A heat exchanger as claimed in claim 1, wherein an interval between the at least one row of the inlet openings of each plate associated with the first fluid and the corresponding at least one row of the outlet openings, associated with the first fluid, is substantially equivalent to an interval between the at least one row of the inlet openings of the plate and the at least one row of outlet openings associated with the second fluid.

3. A heat exchanger as claimed in claim 1, characterised in that the rows of openings are each symmetrical in relation to a central geometric axis (A—A) through the plate in the first direction.

4. A heat exchanger as claimed in claim 1, wherein the two end portions of the plates, inclusive of the rows of openings are symmetrical in relation to a central geometric axis passing through the plate in a direction which is at right angles both to the first and to the second said directions.

5. A heat exchanger as claimed in claim 1, wherein the elements include a collar extending around each opening and wherein the collars on adjacent plates, which face towards one another, bear against each other in a sealing relationship.

6. A heat exchanger as claimed in claim 5, wherein the collars at the inlet openings in one end portion, are all at the same side of the plate but directed oppositely to the collars surrounding the outlet openings in the same end portion.

7. A heat exchanger as claimed in claim 5, further comprising perforated spacer rings arranged between the collars on adjacent plates, which collars face away from one another and are aligned with each other.

8. A heat exchanger as claimed in claim 1, characterised in that each of said elements comprises a collar extending around each opening and in that the collars on adjacent plates which collars face towards one another, bear against each other in a sealing relationship.

9. A heat exchanger as claimed in claim 1, characterised in that the collars at the inlet openings in one end portion, are all at the same side but directed oppositely to the collars surrounding the outlet openings in the same end portion.

10. A heat exchanger as claimed in claim 1, characterised in that perforated spacer rings are arranged between collars on adjacent plates which face away from one another and are aligned with each other.

11. A heat exchanger comprising a stack of plates each of which comprises, in a first direction, a first end portion, a second end portion and an intervening heat exchange surface, both the end portions exhibiting an inlet for the one flow and an outlet for the other, and means being provided in order to separate from one another the spaces located adjacent one another and between adjacent plates, every other one of said spaces carrying the one flow and the others carrying the other flow, characterised in that the inlet and the outlet are each arranged in the form of a plurality of openings in each plate, which openings are located in one or more rows separate from but arranged in parallel with the one or more rows of outlet openings in each plate end portion, the one or more rows of openings extending in a second direction transversely of the first direction of the plates, elements being provided, in order to separate the inlet from the outlet in each end portion of the stack, in the spaces between adjacent plates so that in each space all the openings of the inlet at one end portion of one plate, and all the openings of the outlet at the other end portion of the plate, communicate with the space, an interval between the rows of inlet openings associated with the one flow and the corresponding outlet openings being substantially equivalent to the interval between the rows of inlet openings and outlet openings associated with the other flow, and the two end portions of the plates, inclusive of the rows of openings being symmetrical in relation to a central geometric axis passing through the plate in a direction which is at right angles both to the first and to the second said directions.

* * * * *